US008798516B2

(12) United States Patent
Okamoto et al.

(10) Patent No.: US 8,798,516 B2
(45) Date of Patent: Aug. 5, 2014

(54) CLEANING DEVICE, AND IMAGE FORMING APPARATUS, PROCESS CARTRIDGE, AND INTERMEDIATE TRANSFER UNIT EACH INCLUDING THE CLEANING DEVICE

(75) Inventors: Keiji Okamoto, Kanagawa (JP); Kazuhiko Watanabe, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 667 days.

(21) Appl. No.: 12/929,891

(22) Filed: Feb. 23, 2011

(65) Prior Publication Data

US 2011/0229186 A1 Sep. 22, 2011

(30) Foreign Application Priority Data

Mar. 18, 2010 (JP) ..... 2010-062573

(51) Int. Cl.
*G03G 21/00* (2006.01)

(52) U.S. Cl.
USPC ..... 399/351; 399/350

(58) Field of Classification Search
CPC ..... G03G 2215/0805; G03G 21/0011; G03G 21/0017; G03G 21/0029
USPC ..... 399/350, 351
See application file for complete search history.

(56) References Cited

U.S. PATENT DOCUMENTS

| | | | |
|---|---|---|---|
| 7,383,013 | B2 | 6/2008 | Watanabe et al. |
| 7,711,308 | B2 | 5/2010 | Hozumi et al. |
| 2003/0035668 | A1* | 2/2003 | Endo et al. ..... 399/350 |
| 2007/0242992 | A1 | 10/2007 | Watanabe et al. |
| 2008/0063448 | A1 | 3/2008 | Hozumi et al. |
| 2008/0286020 | A1 | 11/2008 | Watanabe et al. |
| 2009/0010692 | A1 | 1/2009 | Hozumi et al. |
| 2009/0123205 | A1 | 5/2009 | Watanabe et al. |
| 2010/0061779 | A1 | 3/2010 | Okamoto |
| 2010/0067945 | A1 | 3/2010 | Hozumi et al. |
| 2010/0067949 | A1 | 3/2010 | Watanabe et al. |

FOREIGN PATENT DOCUMENTS

| | | | |
|---|---|---|---|
| JP | 3276462 | A | 2/2002 |
| JP | 2007086202 | A | 4/2007 |
| JP | 2007248737 | A | 9/2007 |

OTHER PUBLICATIONS

Abstract of JP 06-208323 published on Jul. 26, 1994.

* cited by examiner

*Primary Examiner* — David Gray
*Assistant Examiner* — Andrew Do
(74) *Attorney, Agent, or Firm* — Harness, Dickey & Pierce, P.L.C.

(57) ABSTRACT

A cleaning device cleaning a moving surface of a cleaning target includes a laminate-structured blade member including multiple layers made of materials different in permanent set value, a holding member to hold a proximal end of the laminate-structured blade member, and a plurality of slits. An edge layer of the multiple layers is formed of a material higher in permanent set value than any other one of the materials of the multiple layers and includes a distal-end edge portion corresponding to a leading end ridgeline portion contacting the cleaning target. The plurality of slits are formed over an area of a surface of the edge layer ranging from the proximal end of the blade member where the holding member holds the blade member toward the distal-end edge portion and extend in a direction perpendicular to a moving direction of the surface of the cleaning target.

17 Claims, 8 Drawing Sheets

CLEANING DEVICE, AND IMAGE FORMING APPARATUS, PROCESS CARTRIDGE, AND INTERMEDIATE TRANSFER UNIT EACH INCLUDING THE CLEANING DEVICE

CROSS-REFERENCE TO RELATED APPLICATIONS

The present invention claims priority pursuant to 35 U.S.C. §119 from Japanese Patent Application No. 2010-062573, filed on Mar. 18, 2010 in the Japan Patent Office, which is hereby incorporated by reference herein in its entirety.

BACKGROUND OF THE INVENTION

1. Field of the Invention

The present invention relates to a cleaning device that removes foreign materials adhering to a surface of a surface moving member (i.e., a member having a moving surface). The present invention further relates to an image forming apparatus, such as a copier, a printer, and a facsimile machine, a process cartridge, and an intermediate transfer unit, each of which includes the cleaning device.

2. Description of the Related Art

There is a wide variety of image forming apparatuses, such as electrophotographic image forming apparatuses and inkjet image forming apparatuses, and many of the image forming apparatuses are provided with surface moving members. For example, some of the electrophotographic image forming apparatuses are provided with surface moving members including a latent image carrying member (i.e., image carrying member), such as a photoconductor drum; an intermediate transfer member (i.e., image carrying member), such as an intermediate transfer belt; and a recording medium conveying member, such as a sheet conveying belt. Further, some of the inkjet image forming apparatuses are provided with surface moving members including a recording medium conveying member, such as a sheet conveying belt. In general, unnecessary foreign materials adhering to a surface of such a surface moving member causes a variety of problems. Therefore, a cleaning device is used that removes the unnecessary foreign materials from the surface of the surface moving member as a cleaning target.

Related-art cleaning devices that clean a surface of the cleaning target include a cleaning device using a blade member formed by an elastic member made of, for example, urethane rubber molded into a plate shape. In such a cleaning device, the blade member is held by a holding member made of a highly rigid material, such as metal, and fixed to the fixed to the frame of the device, and one end of the blade member is pressed against the surface of the cleaning target to remove the foreign materials adhering to the surface. Such a cleaning device is simple in configuration and low in cost, and exhibits high foreign materials removal performance, and thus is widely used.

In the cleaning device according to the blade cleaning method, it is desired to bring the blade member into contact with the surface of the cleaning target with relatively high contact pressure to obtain high removal performance. It is also desired to maintain the initial contact state of the blade member to obtain stable removal performance over time.

In a single-layer structured blade member, the entirety of which is made of a uniform elastic material, however, it is difficult to attain both relatively high contact pressure and maintenance of the initial contact state for the following reason.

That is, if a single-layer structured blade member made of an elastic material of relatively high hardness is used, an edge portion of the blade member in contact with the cleaning target has a relatively small amount of deformation, and an increase in contact area of the blade member in contact with the cleaning target is suppressed. It is therefore possible to set relatively high contact pressure, and to improve the cleaning performance. In general, however, an elastic material of relatively high hardness has a relatively high permanent set value. The blade member is in contact with the cleaning target, with one end thereof pressed and flexed against the surface of the cleaning target. In this case, if the blade member made of an elastic material having a relatively high permanent set value is kept in continuous contact with the cleaning target for an extended period of time, so-called loss of resilience occurs, i.e., the blade member is substantially permanently deformed in a flexed shape. As a result, the contact state of the blade member over time deviates from the initial contact state, and causes a cleaning failure.

By contrast, an elastic material of relatively low hardness generally has a relatively low permanent set value. Therefore, if a single-layer structured blade member made of an elastic material of relatively low hardness is used, the blade member is relatively resistant to the loss of resilience even if the blade member is kept in continuous contact with the cleaning target for an extended period of time, and the initial contact state can be maintained. However, an edge portion of the blade member in contact with the cleaning target is substantially deformed. Thus, the contact area is increased, and the contact pressure is reduced. As a result, sufficient removal performance is not obtained.

As described above, in a single-layer structured blade member, it is difficult to attain both relatively high contact pressure and maintenance of the initial contact state, and to stably obtain high removal performance over time.

Another related-art cleaning device in known, which uses a double-layer laminate-structured blade member made of elastic materials mutually different in hardness. An edge layer of the blade including an edge portion that comes into contact with the cleaning target is made of a material of relatively high hardness, and a backup layer not in contact with the cleaning target is made of a material of relatively low hardness. With the edge layer of relatively high hardness, the edge portion in contact with the cleaning target has a relatively small amount of deformation, and an increase in contact area is suppressed, as in the above-described single-layer structured blade member made of an elastic material of relatively high hardness. Accordingly, relatively high contact pressure can be set. Further, the backup layer not in contact with the cleaning target has relatively low hardness and a relatively low permanent set value. Accordingly, the blade member is more resistant to the loss of resilience than the single-layer structured blade member of relatively high hardness, and is capable of maintaining the initial contact state.

However, as previously described, the double-layer laminate-structured blade member includes the edge layer made of an elastic material of relatively high hardness and a backup layer made of a material of relatively low hardness. When the blade member is pressed and flexed against a cleaning target, not only the backup layer, which is relatively resistant to the loss of resilience, but also the edge layer, which is relatively susceptible to the loss of resilience, is flexed. Therefore, the change over time in contact state occurs more easily than in the single-layer structured blade member solely of the same material as the material forming the backup layer.

The configuration of the blade member including the edge layer made of a material having relatively high hardness and a relatively high permanent set value is advantageous in that the deformation of the edge portion is reduced, the increase in contact area is suppressed, and relatively high contact pressure can be set. The same advantages can also be obtained by the edge layer provided only to a leading edge portion of the blade member.

The configuration is obtained by first preparing a double-layer structured blade member similar to the above-described blade member and thereafter removing a portion of the edge layer other than a leading end portion thereof. However, for removing the portion of the edge layer, considerable effort is taken in peeling or scraping the portion from the backup layer, and the productivity in mass producing the blade members is reduced.

SUMMARY OF THE INVENTION

The present invention describes a novel cleaning device. In one embodiment, a cleaning device cleans a moving surface of a cleaning target and includes a laminate-structured blade member, a holding member, and a plurality of slits. The laminate-structured blade member includes multiple layers made of materials having different permanent set value. The multiple layers include an edge layer formed of a material higher in permanent set value than any other one of the materials of the multiple layers of the laminate-structured blade member. The edge layer includes a distal-end edge portion corresponding to a leading end ridgeline portion and brought into contact with the surface of the cleaning target. The holding member holds a proximal end of the laminate-structured blade member. The plurality of slits are formed on a surface of the edge layer over an area of the edge layer ranging from the proximal end of the blade member where the holding member holds the blade member toward the distal-end edge portion. The plurality of slits extend in a direction perpendicular to a moving direction of the surface of the cleaning target.

The above-described cleaning device may further include an adhesion inhibitor applied to the slits to inhibit adjacent slits thereof from collapsing into each other.

The plurality of slits may inhibit adjacent slits from collapsing into each other.

The slits may be V-shaped grooves in cross-section.

The plurality of slits may be rounded grooves in cross-section.

The surfaces of the plurality of slits may be roughened.

A linear pressure reduction rate in a state of contact of the blade member with the cleaning target may be approximately 90% or higher.

The plurality of slits may be provided in an area on the surface of the edge layer apart from a portion of the edge layer in contact with the surface of the cleaning target.

The depth of each of the plurality of slits may be equal to or smaller than the thickness of the edge layer.

The slits may be provided at a plurality of locations in an area extending to the proximal end of the blade member near the holding position.

The arrangement of intervals of the slits may be different between the proximal end of the blade member and the distal-end portion of the edge layer of the blade member.

The arrangement of depths of the slits is different between the proximal end of the blade member and the distal-end portion of the edge layer of the blade member.

The present invention further describes a novel process cartridge. In one embodiment, a process cartridge is disposed detachably attachable to the body of an image forming apparatus and includes a latent image carrying member and the above-described cleaning device. The latent image carrying member forms an image on a moving surface thereof to transfer the image onto a recording medium.

The present invention further describes a novel intermediate transfer unit. In one embodiment, an intermediate transfer unit is detachably attachable to the body of an image forming apparatus. The intermediate transfer unit includes an intermediate transfer member and the above-described cleaning device. The intermediate transfer member receives an image from a moving surface of an image carrying member, forms the image on a moving surface thereof, and finally transfer the image onto a recording medium.

The present invention further describes a novel image forming apparatus. In one embodiment, an image forming apparatus ultimately transfer, onto a recording medium, an image formed on a moving surface of an image carrying member serving as a moving surface member. The image forming apparatus includes the above-described cleaning device.

Toner particles forming the image have a shape factor SF1 in a range of from approximately 100 to approximately 150.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF PREFERRED EMBODIMENTS

Figure 1:
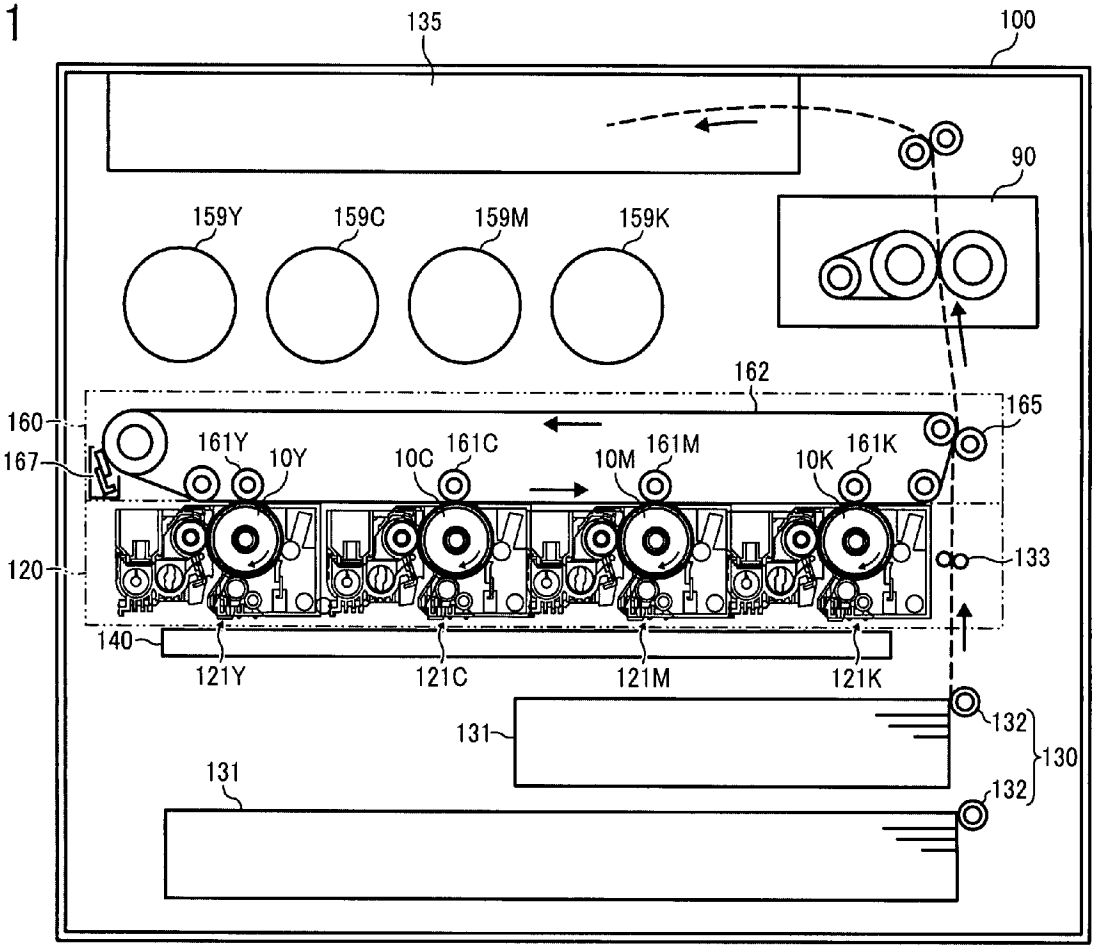
FIG. 1 is a schematic configuration diagram of a printer according to an embodiment of the present invention.

In describing the embodiments illustrated in the drawings, specific terminology is employed for the purpose of clarity. However, the disclosure of this patent specification is not intended to be limited to the specific terminology so used, and it is to be understood that substitutions for each specific element can include any technical equivalents that operate in a similar manner and achieve a similar result.

Referring now to the drawings, wherein like reference numerals designate identical or corresponding parts throughout the several views, a description will be given of a printer as an image forming apparatus according to an embodiment of the present invention.

FIG. 1 is a schematic configuration diagram illustrating a printer 100 as the image forming apparatus according to the present embodiment. The printer 100 forms a full-color image, and is configured to mainly include an image forming unit 120, a secondary transfer device 160, and a sheet feeding unit 130. In the following description, suffixes Y, C, M, and K represent members for yellow, cyan, magenta, and black colors, respectively.

The image forming unit 120 includes process cartridges 121Y, 121C, 121M, and 121K for yellow, cyan, magenta, and black toners, respectively, which are arranged in this order from the left side of the drawing. The process cartridges 121Y, 121C, 121M, and 121K (hereinafter occasionally collectively referred to as the process cartridges 121) are arranged in a substantially horizontal direction. The process cartridges 121Y, 121C, 121M, and 121K include drum-like photoconductors 10Y, 10C, 10M, and 10K (hereinafter occasionally collectively referred to as the photoconductors 10), respectively, each serving as a latent image carrying member, which is an image carrying member having a moving surface.

The secondary transfer device 160 is configured to mainly include a circular intermediate transfer belt 162, which is an intermediate transfer member stretched over a plurality of support rollers, primary transfer rollers 161Y, 161C, 161M, and 161K (hereinafter occasionally collectively referred to as the primary transfer rollers 161), and a secondary transfer roller 165. The intermediate transfer belt 162 is provided above the process cartridges 121, and extends along the moving direction of the respective surfaces of the photoconductors 10. A surface of the intermediate transfer belt 162 moves in synchronization with the movement of the respective surfaces of the photoconductors 10. Further, the primary transfer rollers 161 are arranged on the side of the inner circumferential surface of the intermediate transfer belt 162. The primary transfer rollers 161 bring the lower side of the outer circumferential surface (i.e., outer surface) of the intermediate transfer belt 162 into weak pressure contact with the outer circumferential surface (i.e., outer surface) of each of the photoconductors 10.

The process cartridges 121 are substantially the same in configuration and operation of forming a toner image on the photoconductor 10 and transferring the toner image onto the intermediate transfer belt 162. The primary transfer rollers 161Y, 161C, and 161M corresponding to three process cartridges for a color image, i.e., the process cartridges 121Y, 121C, and 121M are provided with a not-illustrated swing mechanism that vertically swings the primary transfer rollers 161Y, 161C, and 161M. The swing mechanism operates to prevent the intermediate transfer belt 162 from coming into contact with the photoconductors 10Y, 10C, and 10M when a color image is not formed.

The secondary transfer device 160 serving as an intermediate transfer unit is configured to be attachable to and detachable from the body of the printer 100. Specifically, a not-illustrated front cover provided on the near side of FIG. 1 to cover the image forming unit 120 of the printer 100 is opened, and the secondary transfer device 160 is slid from the far side toward the near side of FIG. 1. Thereby, the secondary transfer device 160 can be detached from the body of the printer 100. To attach the secondary transfer device 160 to the body of the printer 100, an operation reverse to the detaching operation is performed.

At a position on the intermediate transfer belt 162 downstream of the secondary transfer roller 165 and upstream of the process cartridge 121Y in the surface moving direction of the intermediate transfer belt 162, an intermediate transfer belt cleaning device 167 is provided to remove foreign materials, such as residual toner remaining after the secondary transfer operation, adhering to the intermediate transfer belt 162. The intermediate transfer belt cleaning device 167 supported integrally with the intermediate transfer belt 162 is configured to be attachable to and detachable from the body of the printer 100 as a part of the secondary transfer device 160.

Above the secondary transfer device 160, toner cartridges 159Y, 159C, 159M, and 159K corresponding to the process cartridges 121Y, 121C, 121M, and 121K, respectively, are arranged in a substantially horizontal direction. Below the process cartridges 121Y, 121C, 121M, and 121K, an exposure device 140 is provided that applies laser light to the charged surface of each of the photoconductors 10Y, 10C, 10M, and 10K to form an electrostatic latent image thereon. Below the exposure device 140, the sheet feeding unit 130 is provided. The sheet feeding unit 130 includes sheet feeding cassettes 131 for storing transfer sheets serving as recording media and sheet feeding rollers 132. The sheet feeding unit 130 feeds each of the transfer sheets at predetermined timing toward a secondary transfer nip portion, which is formed between the intermediate transfer belt 162 and the secondary transfer roller 165, via a registration roller pair 133. On the downstream side of the secondary transfer nip portion in the transfer sheet conveying direction, a fixing device 90 is provided. On the downstream side of the fixing device 90 in the transfer sheet conveying direction, sheet discharging rollers and a discharged sheet storing unit 135 that stores a discharged transfer sheet are provided.

Figure 2:
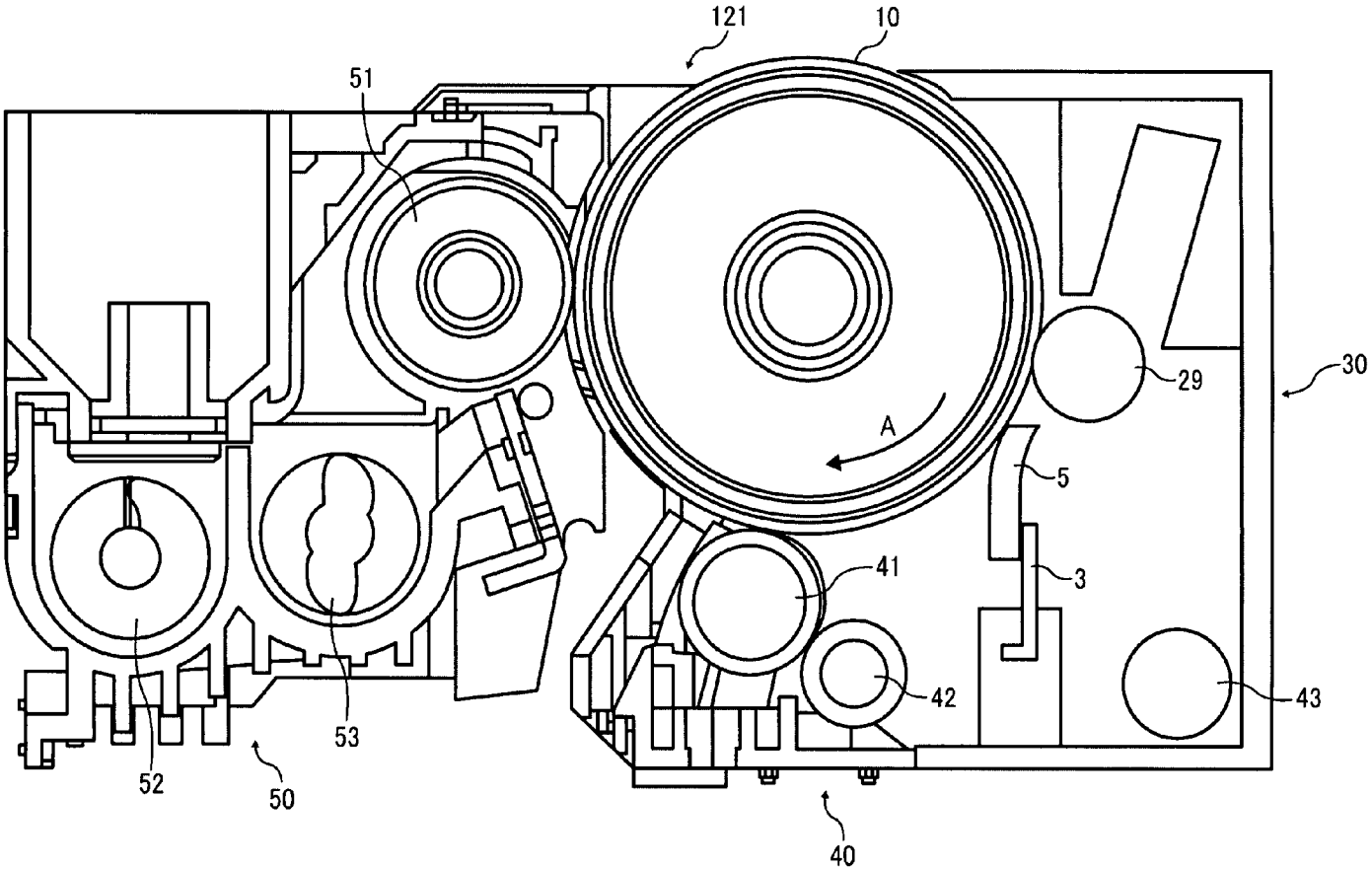
FIG. 2 is a schematic diagram of a configuration of a process cartridge provided in the printer.

FIG. 2 is a schematic configuration diagram illustrating one of the process cartridges 121 provided in the printer 100. Herein, the process cartridges 121 are substantially similar in configuration. In the following, therefore, a description will be given of the configuration and operation of the process cartridges 121, with the suffixes Y, C, M, and K for identifying the colors omitted. The process cartridge 121 includes the photoconductor 10, and a cleaning device 30, a charging device 40, and a development device 50 arranged around the photoconductor 10.

The cleaning device 30 includes a blade holder 3, a blade member 5, which is an elastic member extending in the direction of the rotation axis of the photoconductor 10, a brush roller 29, and a discharge screw 43. In the cleaning device 30, a side (i.e., a contact side) of the blade member 5 extending in the longitudinal direction thereof, which forms an edge portion, is pressed against the surface of the photoconductor 10 to scrape off and remove unnecessary foreign materials, such as post-transfer residual toner, adhering to the surface of the photoconductor 10. Then, the brush roller 29 sweeps the foreign materials away toward the discharge screw 43 from the upstream side of the contact position of the blade member 5 in contact with the photoconductor 10 in the surface moving direction of the photoconductor 10, and the discharge screw 43 discharges the foreign materials to the outside of the cleaning device 30. In the present embodiment, conductive PET (polyethylene terephthalate) is used as a fiber material forming the brush roller 29. Detailed description of the cleaning device 30 will be given later.

The cleaning device 30 may include a lubricant application device. The lubricant application device may be configured to include a solid lubricant, a lubricant support member that supports the solid lubricant, and the brush roller 29 that rotates while in contact with both the solid lubricant and the photoconductor 10. In this type of lubricant application device, the brush roller 29 scrapes the solid lubricant into powder and applies the powdered lubricant to the surface of the photoconductor 10. Further, in the lubricant application device configured to apply the lubricant to the surface of the photoconductor 10 by using the brush roller 29, an application blade may be provided downstream of the brush roller 29 in the surface moving direction of the photoconductor 10 to come into contact with the surface of the photoconductor 10. The application blade, which is supported by an application blade holder such that a leading end portion of the application blade is in contact with the surface of the photoconductor 10, levels the lubricant applied to the surface of the photoconductor 10 into a uniform thickness.

The charging device 40 is configured to mainly include a charging roller 41 arranged to be in contact with the photoconductor 10 and a charging roller cleaner 42 that rotates while in contact with the charging roller 41.

The development device 50 supplies toner to the surface of the photoconductor 10, so as to visualize the electrostatic latent image that is formed on the surface, and is configured to mainly include a development roller 51, a mixing screw 52, and a supplying screw 53. The development roller 51 serves as a developer carrying member that carries a developer on a surface thereof. The mixing screw 52 conveys the developer contained in a developer container while mixing the developer. The supplying screw 53 conveys the mixed developer while supplying the developer to the development roller 51.

Each of the four process cartridges 121 having the above-described configuration can be independently attached, detached, and replaced by a service technician or user. Further, the process cartridge 121 detached from the printer 100 is configured to allow each of the photoconductor 10, the charging device 40, the development device 50, and the cleaning device 30 to be independently replaced with a new replacement member. The process cartridge 121 may include a waste toner tank for collecting the post-transfer residual toner collected by the cleaning device 30. In this case, if the process cartridge 121 is configured to allow the waste toner tank to be independently attached, detached, and replaced, convenience is improved.

Subsequently, the operation of the printer 100 will be described. Upon receipt of a print instruction from an external device, such as a not-illustrated operation panel or personal computer, the printer 100 first rotates the photoconductor 10 in the direction indicated by an arrow A in FIG. 2, and causes the charging roller 41 of the charging device 40 to uniformly charge the surface of the photoconductor 10 to a predetermined polarity. The respective charged photoconductors 10 are then applied by the exposure device 140 with, for example, laser beams for the respective colors optically modulated in accordance with input color image data. Thereby, electrostatic latent images corresponding to the respective colors are formed on the respective surfaces of the photoconductors 10. Each of the electrostatic latent images is supplied with a developer of the corresponding color from the development roller 51 of the development device 50 for the color. Thereby, the electrostatic latent images corresponding to the respective colors are developed by the developers of the respective colors and visualized as toner images corresponding to the respective colors. Then, the primary transfer rollers 161 are applied with a transfer voltage opposite in polarity to the toner images. Thereby, a primary transfer electric field is formed between the photoconductors 10 and the primary transfer rollers 161 via the intermediate transfer belt 162. Further, the primary transfer rollers 161 bring the intermediate transfer belt 162 into weak pressure contact with the photoconductors 10 to form respective primary transfer nips. Due to the above-described functions, the respective toner images on the photoconductors 10 are efficiently primarily transferred onto the intermediate transfer belt 162. Consequently, the toner images of the respective colors formed on the photoconductors 10 are transferred onto the intermediate transfer belt 162 to be superimposed on one another, and a laminated toner image is formed.

Meanwhile, a transfer sheet stored in one of the sheet storing cassettes 131 is fed at predetermined timing by the corresponding sheet feeding roller 132, the registration roller pair 133, and so forth. Then, the secondary transfer roller 165 is applied with a transfer voltage opposite in polarity to the laminated toner image primarily transferred onto the intermediate transfer belt 162. Thereby, a secondary transfer electric field is formed between the intermediate transfer belt 162 and the secondary transfer roller 165 via the transfer sheet, and the laminated toner image is transferred onto the transfer sheet. The transfer sheet having the laminated toner image transferred thereto is then conveyed to the fixing device 90, and the toner image is fixed on the transfer sheet with head and pressure applied thereto. The transfer sheet having the toner image fixed thereon is discharged to and placed on the discharged sheet storing unit 135 by the sheet discharging rollers. Meanwhile, post-transfer residual toner remaining on each of the photoconductors 10 after the primary transfer operation is scrapped off and removed by the blade member 5 of the corresponding cleaning device 30.

A description will now be given of an example of a blade member provided in a currently used cleaning device in FIG. 3.

Figure 3:
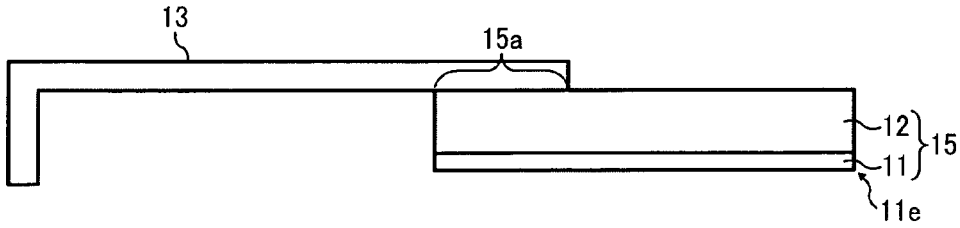
FIG. 3 is an explanatory diagram of an example of a blade holder and a double-layer laminate-structured blade member.

FIG. 3 is an explanatory diagram of a double-layer laminate-structured blade member 15 and a blade holder 13 holding the blade member 15. The blade member 15 includes an edge layer 11 made of an elastic material of relatively high hardness and a backup layer 12 made of an elastic material of relatively low hardness.

In the blade member 15 illustrated in FIG. 3, the edge layer 11 having a relatively high permanent set value extends over an entire area from a holding position 15*a* held by the blade holder 13 to the leading end of the blade member 15 on the side of an edge portion 11*e*. Therefore, in a state in which the blade member 15 is pressed and flexed against a cleaning target, not only the backup layer 12, which is relatively resistant to the loss of resilience, but also the edge layer 11, which is relatively susceptible to the loss of resilience, is flexed. If the blade member 15 is kept in continuous contact with the cleaning target for an extended period of time, therefore, a substantial loss of resilience may occur only in the edge layer 11.

If the loss of resilience occurs in the edge layer 11, the edge layer 11 tends to maintain the flexed shape thereof. Thus, the backup layer 12 with little or no loss of resilience receives force acting in the flexing direction. Therefore, the change over time in contact state occurs more easily than in the single-layer structured blade-member made solely of the same material as the material forming the backup layer 12.

The configuration of the blade member 15 including the edge layer 11 made of a material having relatively high hardness and a relatively high permanent set value is advantageous in that the deformation of the edge portion 11*e* is reduced, the increase in contact area is suppressed, and relatively high contact pressure can be set. The same advantages can also be obtained by the edge layer 11 provided only to a leading end portion of the blade member 15, as illustrated in FIGS. 4A and 4B.

Figure 4A:
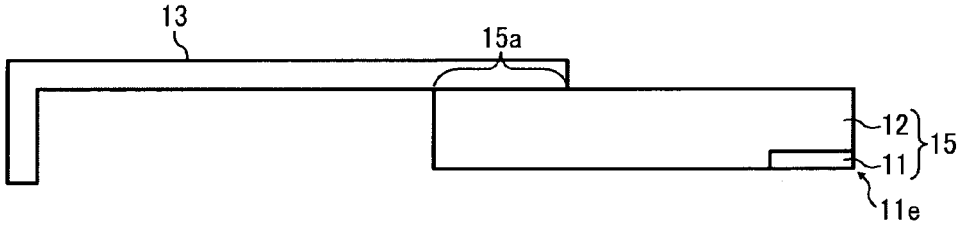
FIGS. 4A and 4B are explanatory diagrams of other examples of a blade holder and a blade member including an edge layer only in a leading end portion thereof, FIG. 4A illustrating a configuration of lamination in which only a part of the leading end portion forms the edge layer, and FIG. 4B illustrating a configuration in which a portion of the edge layer other than a leading end portion thereof is removed.
Figure 4B:
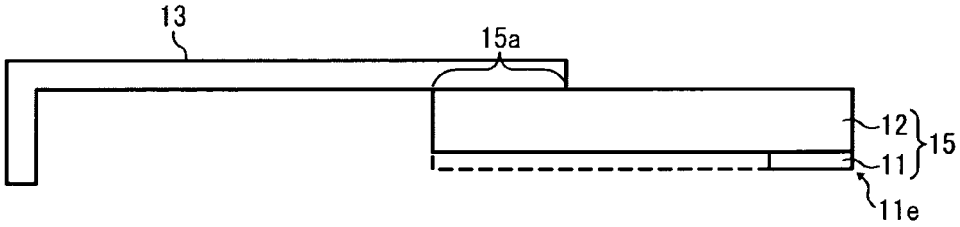

FIGS. 4A and 4B are explanatory diagrams of the blade member 15, which is capable of suppressing the change in contact state attributed to the loss of resilience occurring in the edge layer 11, and the blade holder 13 holding the blade member 15. FIG. 4A illustrates a configuration that includes, only in a leading end portion of the blade member 15 forming an edge portion, the edge layer 11 made of a material having relatively high hardness and a relatively high permanent set value, and in which the remaining portion of the blade member 15 is formed by the backup layer 12. FIG. 4B illustrates a configuration obtained by first preparing the double-layer structured blade member 15 similar to the blade member 15 of FIG. 3 and thereafter removing a portion of the end layer 11 other than a leading end portion thereof indicated by a broken line in the drawing.

In the blade member 15 illustrated in FIGS. 4A and 4B, only the backup layer 12, which is relatively resistant to the loss of resilience, extends over the entire area from the holding position 15*a* to the leading end of the blade member 15 on the side of the edge portion 11*e*, and the edge layer 11, which is relatively susceptible to the loss of resilience, is provided only to a leading end portion of the blade member 15. When the blade member 15 is pressed and flexed against the cleaning target, therefore, the backup layer 12, which is relatively resistant to the loss of resilience, is flexed. This configuration attains both relatively high contact pressure and maintenance of the initial contact state.

As a method of mass-producing laminate-structured blade members, however, a method using a centrifugal molding machine is commonly employed that forms the entirety of the individual blade member into a laminated structure. It is therefore necessary to use another new method to produce the blade member 15, only the leading end portion of which is formed by a different material, as illustrated in FIG. 4A. In this regard, this method is open to improvement. Further, in a structure in which the edge layer 11 and the backup layer 12 relatively easily separate from each other at the interface thereof, the edge layer 11 tends to separate from the backup layer 12 during the cleaning and the double-layer structure disintegrates. To prevent this, the edge layer 11 and the backup layer 12 are firmly fixed to each other. Therefore, to remove a portion of the edge layer 11 other than the leading end portion thereof, as in FIG. 4B, considerable effort is taken in peeling or scraping the portion indicated by the broken line in FIG. 4B from the backup layer 12, and the productivity in mass producing the blade members is reduced.

Figure 5:
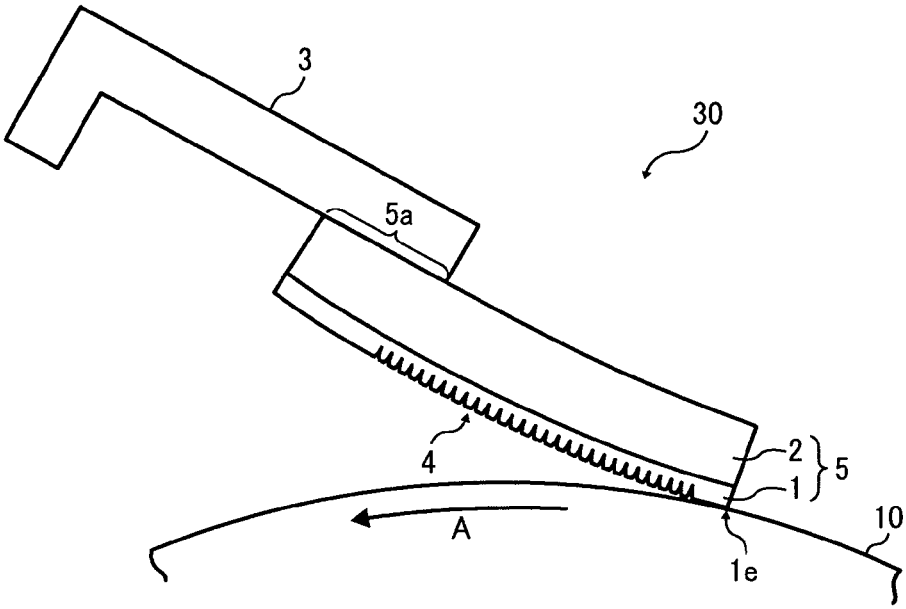
FIG. 5 is an explanatory diagram of a portion of a blade member of a cleaning device according to an embodiment of the present invention in contact with a photoconductor.

Now, a detailed description will be given of the cleaning device 30, which is a characteristic feature of the present invention. FIG. 5 is an explanatory diagram illustrating a portion of the blade member 5 of the cleaning device 30 in contact with the photoconductor 10, as viewed in the direction of the rotation axis of the photoconductor 10. The cleaning device 30 includes the laminate-structured blade member 5 and the blade holder 3 holding one end of the blade member 5. The blade member 5 is formed by two layers, which include an edge layer 1 and a backup layer 2 made of materials mutually different in permanent set value. The cleaning device 30 is configured to clean the surface of the photoconductor 10 by bringing an edge portion 1*e*, which forms an end portion of the blade member 5 opposite to a side of the blade member 5 held by the blade holder 3, into contact with the surface of the photoconductor 10 moving in the direction indicated by an arrow A in FIG. 5. The edge layer 1 including the edge portion 1*e* is made of a material higher in permanent set value than the material forming the backup layer 2. Further, an area in a surface of the edge layer 1 between a holding position 5*a*, at which the blade member 5 is attached to and held by the blade holder 3, and the edge portion 1*e* is provided with a plurality of slits 4.

In the laminate-structured blade member 15 of the example as illustrated in FIG. 3, the edge layer 11 is made of a material having a relatively high permanent set value, and the backup layer 2 is made of a material having a relatively low permanent set value. This is because, if a blade member is made solely of a material having relatively high hardness and a relatively high permanent set value suitable for use in the edge layer 11, the loss of resilience occurs in the blade member, and thus the blade member fails to maintain stable linear pressure due to the elapsed time or environmental change. The example illustrated in FIG. 3, therefore, is configured to use a material having relatively low hardness and a relatively low permanent set value in the backup layer 12 to suppress the loss of resilience occurring in the entire blade member 15.

Even in the configuration including the edge layer 11 extending over the entire area from the holding position 15*a* to the leading end of the blade member 5 on the side of the edge portion 11*e*, as illustrated in FIG. 3, it is possible to attain both relatively high contact pressure and maintenance of the initial contact state, depending on the combination of materials forming the edge layer 11 and the backup layer 12. In this configuration, however, the selection of materials and the combination of thicknesses are limited.

As a method of manufacturing the blade member 15 used in a configuration that removes small-diameter or spherical toner particles by using a material of relatively high hardness in the edge portion 11*e* forming the leading end of a blade, different materials may be sequentially mixed in a centrifugal molding machine for forming a laminated structure. In this case, however, the edge layer 11 of relatively high hardness is formed not just in a leading end portion of the blade member 15, which essentially requires the edge layer 11, but in the entire area from the holding position 15*a* to the leading end of the blade member 15 on the side of the edge portion 11*e*, as illustrated in FIG. 3. Consequently, the loss of resilience occurs in the edge layer 11, and causes a reduction in linear pressure.

To address the above-described issue, the blade member 5 of the cleaning device 30 according to the present embodiment illustrated in FIG. 5 is configured such that a surface of the edge layer 1 is provided with a plurality of slits (i.e., incisions) 4 to prevent the loss of resilience from occurring in an essentially unnecessary beam portion of the edge layer 1 other than the leading end portion thereof. The edge layer 1, which is a layer of relatively high hardness in contact with the photoconductor 10, is thus provided with the plurality of slits 4. When the blade member 5 is pressed against the photoconductor 10, therefore, the slits 4 open in accordance with the flexure of the blade member 5. Thereby, the set of the edge layer 1 is suppressed, and thus the permanent set of the edge layer 1 is suppressed. Accordingly, the loss of resilience in the edge layer 1 of relatively high hardness is suppressed, and the loss of resilience in the entire blade member 5, which depends on the physical properties of the material forming the edge layer 1, is substantially suppressed.

In the cleaning device 30, the surface of the edge layer 1 facing the photoconductor 10 is provided with the plurality of slits 4. Therefore, when the blade member 5 is pressed against the photoconductor 10, as illustrated in FIG. 5, the slits 4 open and reduce the set of the edge layer 1. Thus, the permanent set is suppressed in the beam portion of the edge layer 1. Accordingly, the loss of resilience depending on the physical properties of the edge layer 1 is substantially reduced, while the physical properties essentially necessary for the edge portion 1*e* are maintained. Further, the blade member 5 is provided to bite into the surface of the photoconductor 10. Therefore, the stress acting on the edge layer 1 is not compressive stress but tensile stress. With the plurality of fine slits 4, therefore, the set of the edge layer 1 is absorbed not as the set of the material forming the edge layer 1 but as the expansion of the slits 4.

Figure 6:
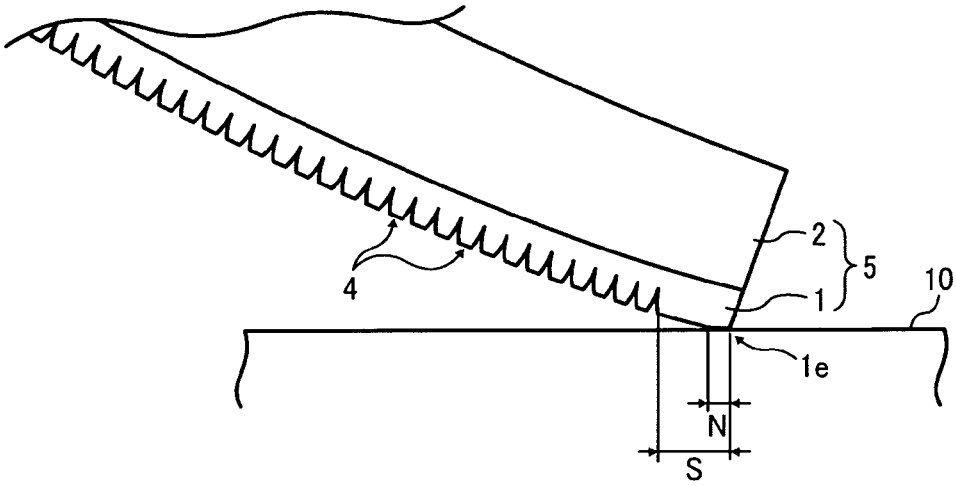
FIG. 6 is an enlarged view of a leading end portion of the blade member according to an embodiment of the present invention.

FIG. 6 is an enlarged view of a leading end portion of the blade member 5 according to the present embodiment. As illustrated in FIG. 6, a distance S between the edge portion 1*e* and one of the plurality of slits 4 provided in the edge layer 1 of the blade member 5 and closest to the edge portion 1*e* is set to exceed a nip width N representing the width, over which the edge layer 1 is in contact with the photoconductor 10. If any of the slits 4 is located in the nip width N, the slit 4 may act as the starting point of turn-up of the blade member 5. Thus, the distance S is set to exceed the nip width N to prevent the blade member 5 from turning up at the slit 4 as the starting point.

Further, as for the deformation of the blade member 5, the stress generated by the flexure of the blade member 5 is increased toward the root of the blade member 5, i.e., toward the holding position 5*a* and reduced toward the leading end of the blade member 5, except for the deformation of the leading end of the blade member 5 occurring in the nip portion. When the nip width N is approximately 100 μm, therefore, the effect obtained by providing the slits 4 is hardly reduced, even if the slits 4 start at a position apart from the edge portion 1*e* by approximately 100 μm.

Embodiment 1

A description is given of a structure of the blade member 5 applicable to the cleaning device 30 according to Embodiment 1 based on the present embodiment.

The structure of the blade member according to Embodiment 1 has a double-layer laminated structure including the edge layer 1 provided with the slits 4 and the backup layer 2.

Figure 7:
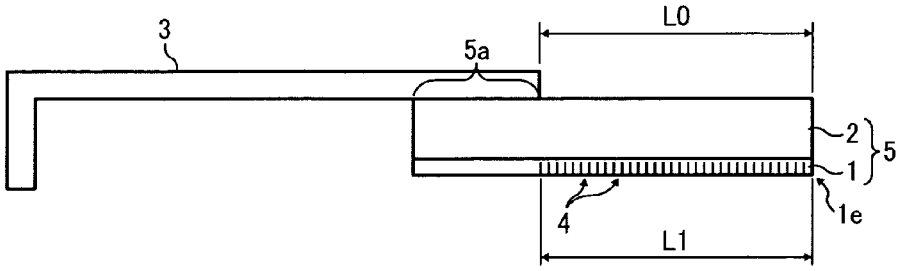
FIG. 7 is an explanatory diagram of the blade member and a blade holder according to Embodiment 1.

FIG. 7 is an explanatory diagram of the blade member 5 and the blade holder 3 holding the blade member 5 according to Embodiment 1. Herein, L0 represents the free length between the leading end of the blade member 5 and a leading end-side end portion of the holding position 5*a*. In Embodiment 1 of the blade member 5, the plurality of slits 4 are provided in an area on the surface of the edge layer 1 from the edge portion 1*e* to a position apart from the edge portion 1*e* by the free length L0. As described above with reference to FIG. 6, if any of the slits 4 is located in the nip width N, the slit 4 may act as the starting point of turn-up of the blade member 5. Therefore, the plurality of slits 4 are arranged toward the root of the blade member 5 from a position apart from the edge portion 1*e* by at least approximately 100 μm, which herein corresponds to the nip width N.

Embodiment 2

A description is given of a structure of the blade member 5 applicable to the cleaning device 30 according to Embodiment 2 based on the present embodiment.

Figure 8:
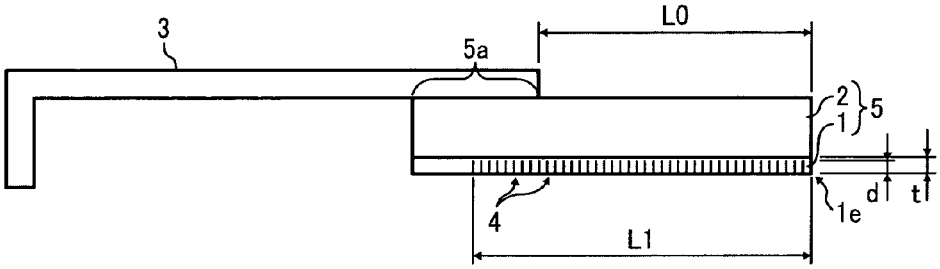
FIG. 8 is an explanatory diagram of the blade member and a blade holder according to Embodiment 2.

FIG. 8 is an explanatory diagram of the blade member 5 and the blade holder 3 holding the blade member 5 according to Embodiment 2. In Embodiment 1, the range of the slits 4 corresponds to the free length L0. Meanwhile, in Embodiment 2, the range of the slits 4 corresponds to a free length L1 greater than the free length L0. The slits 4 are formed such that the depth thereof is less than the thickness of the edge layer 1. That is, when "t" and "d" represent the thickness of the edge layer 1 and the depth of the slits 4, respectively, a relationship "t>d" holds. It is desired herein to set the depth "d" to a value as close as possible to the value of the thickness "t". This is based on the following reason. The smaller the value of the depth "d" is, i.e., the shallower the slits 4 are, the less easily the slits 4 open when the blade member 5 is flexed. To make the slits 4 easily open, it is desired to increase the value of the depth "d" to make the slits 4 deep. If the depth "d" of the slits 4 is excessively increased to exceed the thickness "t", however, the incisions penetrate the backup layer 2. The incisions penetrating the backup layer 2 reduce the strength of the blade member 5. Thus, the value of the depth d of the slits 4 is set to an upper limit not exceeding the thickness t of the edge layer 1. With this setting, the expansion of the slits 4 according to the flexure of the blade member 5 is ensured. Further, the stress on the blade member 5 concentrates on an edge portion of the blade holder 3. If the slits 4 are provided in the range corresponding to the free length L1 greater than the free length L0, therefore, the slits 4 open in the area on which the stress concentrates. Consequently, a better effect of reducing the loss of resilience is obtained.

Embodiment 3

A description is given of a structure of the blade member 5 applicable to the cleaning device 30 according to Embodiment 3 based on the present embodiment.

Figure 9:
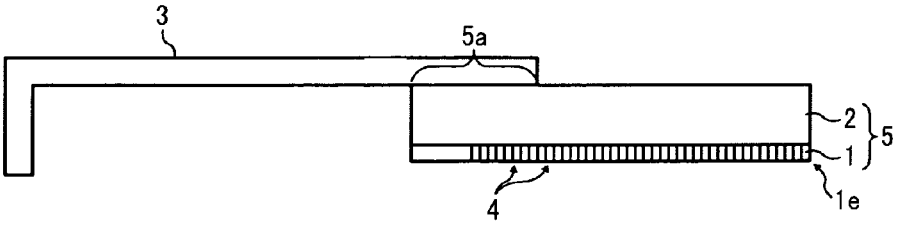
FIG. 9 is an explanatory diagram of the blade member and a blade holder according to Embodiment 3.

FIG. 9 is an explanatory diagram of the blade member 5 and the blade holder 3 holding the blade member 5 according to Embodiment 3. The structures of the blade member 5 of Embodiments 1 and 2 are configured such that the depth "d" of the slits 4 is less than the thickness "t" of the edge layer 1, i.e., the relationship "d<t" holds. Meanwhile, the structure of the blade member 5 of Embodiment 3 is configured to have a relationship "d=t", wherein the depth "d" of the slits 4 is maximized.

The slits 4 are provided to reduce the influence of the permanent set of the edge layer 1 on the loss of resilience occurring in the blade member 5, and the effect of the slits 4 is maximized when the depth "d" thereof is set to the thickness "t" of the edge layer 1. The slits 4 deeper than the thickness "t" of the edge layer 1 reduce the strength of the backup layer 2, and may prevent the blade member 5 from obtaining sufficient pressure. Further, the function of sufficiently adjusting the pressure contact force, which is supposed to be provided by the backup layer 2, may fail to be exerted. Therefore, the depth d of the slits 4 is maximized in the configuration satisfying the relationship "d=t", as in Embodiment 3.

Embodiment 4

A description is given of a structure of the blade member 5 applicable to the cleaning device 30 according to Embodiment 4 based on the present embodiment.

Figure 10A:
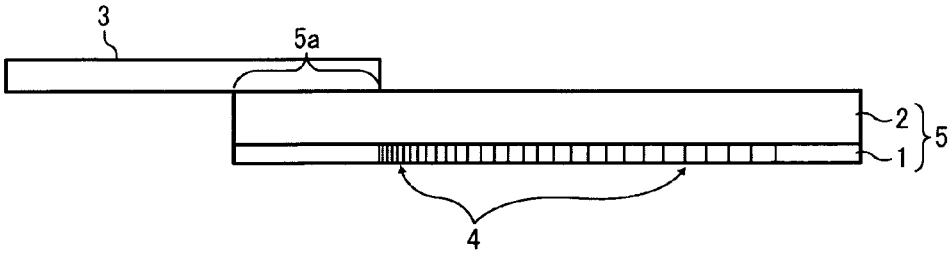
FIGS. 10A and 10B are explanatory diagrams of the blade member and a blade holder according to Embodiment 4, FIG. 10A illustrating a configuration in which the pitch of slits is reduced toward the root of the blade member, and FIG. 10B illustrating a configuration in which the depth of the slits is increased toward the root of the blade member.
Figure 10B:
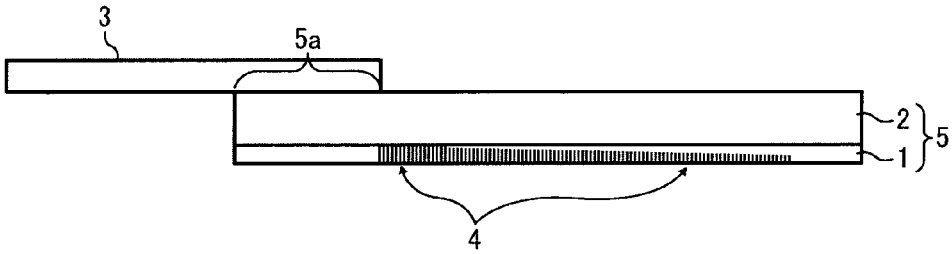

FIGS. 10A and 10B are explanatory diagrams of the blade member 5 and the blade holder 3 holding the blade member 5 according to Embodiment 4. The structures of the blade member 5 of Embodiments 1 through 3 are configured such that the plurality of slits 4 are provided in an area between the root side and the leading end side of the blade member 5 at an equal pitch in the same depth. Meanwhile, the structure of the blade member 5 according to Embodiment 4 is configured such that the arrangement of the slits 4 is different between the root side and the leading end side of the blade member 5.

FIG. 10A is an explanatory diagram of the blade member 5 in which the pitch of the slits 4 is reduced toward the root side to make the distribution of the slits 4 dense on the root side and sparse on the leading end side. FIG. 10B is an explanatory diagram of the blade member 5 in which the depth of the slits 4 is reduced toward the leading end side and increased toward the root side. As described above, the stress generated in the blade member 5 is increased toward the root side. Therefore, the blade member 5 may be configured such that the closer to the root side the slits 4 are, the more easily the slits 4 open, as in the blade member 5 of Embodiment 4.

As described above, in the cleaning device 30 of the present embodiment, the slits 4 are provided in the surface of the edge layer 1 including a ridgeline forming the edge portion 1*e* of the blade member 5. Thereby, the entire blade member 5 is configured to be relatively resistant to the loss of resilience.

Figure 11:
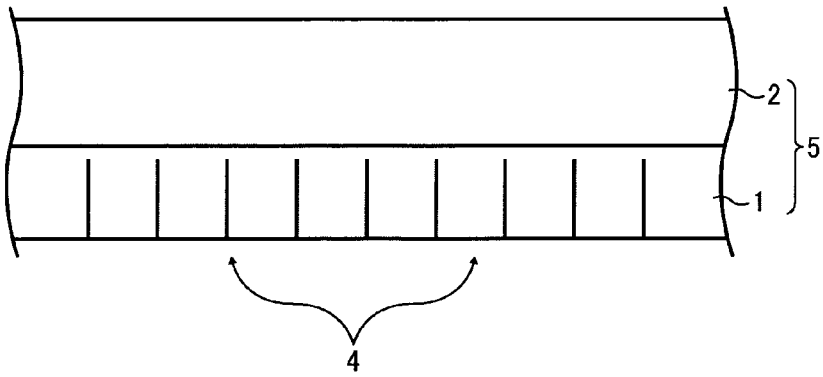
FIG. 11 is an enlarged explanatory diagram of an edge layer formed with slashed slits.

FIG. 11 is an enlarged explanatory diagram of the edge layer 1 formed with the slashed slits 4. When the blade member 5 is cut into a predetermined length, it is common to cut the blade member 5 by using a highly accurate cutter to ensure the accuracy of the edge portion 1*e* used in the cleaning operation. Further, in the process of providing the slashed slits 4 in the surface of the edge layer 1, a method of providing the slits 4 by using the cutter has few methodological disadvantages.

However, if the rectilinear slits 4 are provided by the highly accurate cutter, as illustrated in FIG. 11, mutually facing cut surfaces of the slits 4 highly accurately match each other in the cross-sectional shape thereof. Further, even if the slits 4 are provided in the edge layer 1, which mainly uses urethane rubber as a material thereof, adjacent cut surfaces of the slits 4 may adhere to each other in a vacuum, depending on the composition of the urethane rubber. As a result, the slits 4 may fail to open in accordance with the flexure of the blade member 5, and the effect obtained by providing the slits 4 may fail to be provided.

Embodiment 5

A description is given of a structure of the blade member 5 applicable to the cleaning device 30 according to Embodiment 5 based on the present embodiment.

Figure 12:
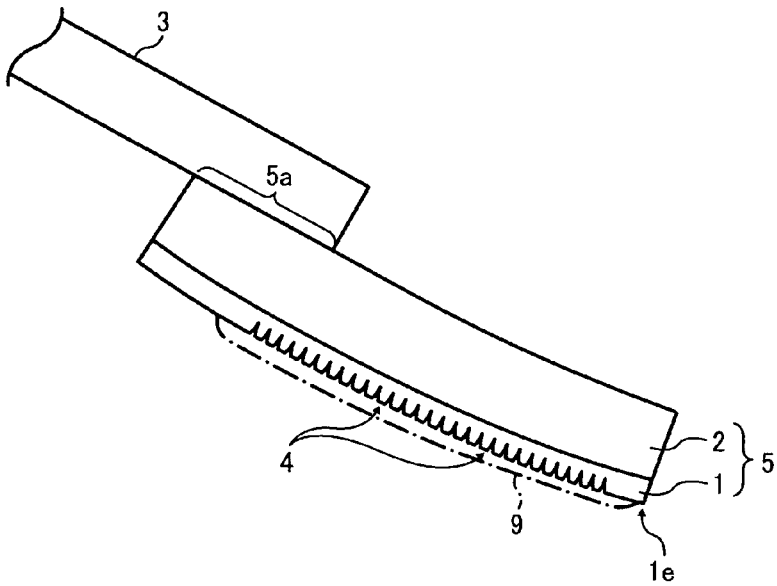
FIG. 12 is an explanatory diagram of the blade member and a blade holder according to Embodiment 5.

FIG. 12 is an explanatory diagram of the blade member 5 and the blade holder 3 holding the blade member 5 according to Embodiment 5. The structure of the blade member of Embodiment 5 is configured such that the cut surfaces of the slashed slits 4 are applied with an adhesion inhibitor 9 made of a substance reducing the surface energy, such as a lubricant and a release agent. The application of the adhesion inhibitor 9 prevents adjacent cut surfaces of the slits 4 from adhering to each other, and allows the slits 4 to smoothly open in accordance with the flexure of the blade member 5. Accordingly, the effect of preventing the loss of resilience by providing the slits 4 is sufficiently exerted.

The adhesion inhibitor 9 may contain, for example, zinc stearate, magnesium stearate, or silica, which is used as a lubricant. Further, the adhesion inhibitor 9 is not limited to the lubricant. The adhesion inhibitor 9 configured as a release agent applied to the cut surfaces of the slits 4 also provides a similar effect. Furthermore, the adhesion inhibitor 9 may be configured as a toner applied to the cut surfaces of the slits 4. The adhesion inhibitor 9 may be of the powder or liquid type, and the material forming the adhesion inhibitor 9 can be selected from a wide range of materials, as long as the materials reduce the surface energy and prevent adjacent cut surfaces of the slits 4 from adhering to each other.

Embodiment 6

A description is given of a structure of the blade member 5 applicable to the cleaning device 30 according to Embodiment 6 based on the present embodiment.

Figure 13A:
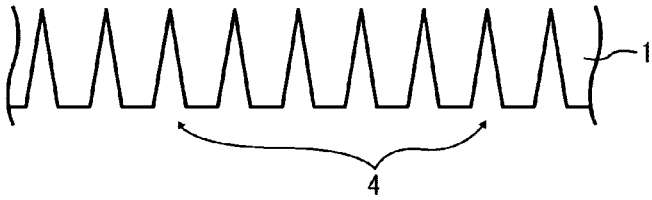
FIGS. 13A to 13C are enlarged explanatory diagrams of an edge layer of the blade member of Embodiment 6, FIG. 13A illustrating an edge layer with slits formed into V-shaped grooves, FIG. 13B illustrating an edge layer with slits formed into V-shaped grooves having deepest portions thereof rounded, and FIG. 13C illustrating an edge layer with slits formed into U-shaped grooves.
Figure 13B:
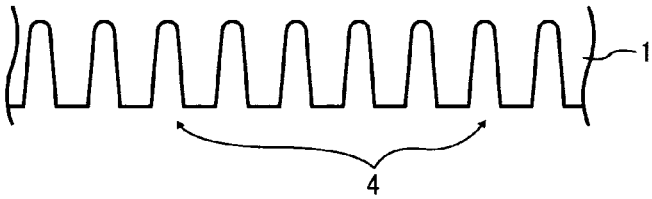
Figure 13C:
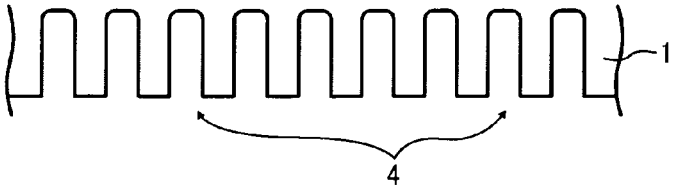

FIGS. 13A to 13C are enlarged explanatory diagrams of the edge layer 1 of the blade member 5 according to Embodiment 6. In the structures of the blade member 5 according to Embodiments 1 through 5, the slits 4 provided in the edge layer 1 of the blade member 5 are rectilinear slashes each having a minute width. By contrast, in the structure of the blade member 5 according to Embodiment 6, the slits 4 provided in the edge layer 1 are grooves each having a greater width. FIG. 13A is an enlarged explanatory diagram of the slits 4 formed into V-shaped grooves. FIG. 13B is an enlarged explanatory diagram of the slits 4 formed into V-shaped grooves, the deepest portions of which are rounded. FIG. 13C is an enlarged explanatory diagram of the slits 4 formed into U-shaped grooves.

In the blade member 5 according to Embodiment 6 illustrated in FIGS. 13A to 13C, parts of the surface of the edge layer 1 are removed to form the groove-like slits 4 each having a certain amount of width. Thereby, adjacent cut surfaces of the slits 4 are prevented from adhering to each other. With this configuration, the slits 4 are allowed to smoothly open in accordance with the flexure of the blade member 5, and the effect of preventing the loss of resilience by providing the slits 4 is sufficiently exerted.

FIG. 13A illustrates a configuration in which the slits 4 are formed into V-shaped grooves to prevent adjacent cut surfaces of the slits 4 from coming into contact with each other in the unflexed state of the blade member 5. The slits 4 illustrated in FIG. 13A have a groove shape formed by a removal process using two angled cutters. The groove shape has few processing disadvantages in, for example, the processing method and the processing time. However, the stress concentrates on angular portions corresponding to the deepest portions of the grooves, and may cause a crack. As a configuration preventing such an undesired phenomenon, it is effective in terms of prevention of a crack to form the slits 4 into a shape having rounded and not angular portions in which the direction of the surface of the slits 4 changes, as illustrated in FIGS. 13B and 13C. The V-shaped groove-like slits 4 having the rounded deepest portions, as illustrated in FIG. 13B, reduce the possibility of causing a crack due to the concentration of stress on the deepest portions of the slits 4. Further, the slits 4 formed into U-shaped grooves, as illustrated in FIG. 13C, have no angular portion on which the stress concentrates, and thus reduce the possibility of causing a crack.

Embodiment 7

A description is given of a structure of the blade member 5 applicable to the cleaning device 30 according to Embodiment 7 based on the present embodiment.

Figure 14:
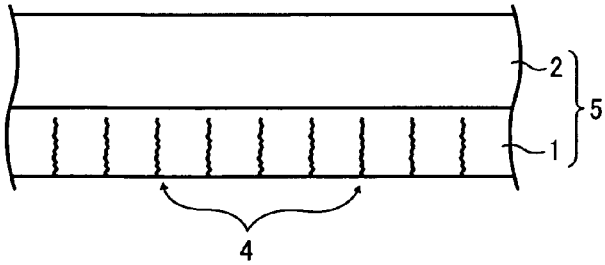
FIG. 14 is an enlarged explanatory diagram of an edge layer of the blade member of Embodiment 7.

FIG. 14 is an enlarged explanatory diagram of the edge layer 1 of the blade member 5 according to Embodiment 7. In the structure of the blade member 5 according to Embodiment 7, the process of providing the slits 4 is performed not by a cutter that produces smooth and flat cut surfaces but by a processing device, such as a thin disk-shaped grindstone, which produces rough cut surfaces. With the processed surfaces (i.e., cut surfaces) of the slits 4 thus roughened, even if the width between mutually facing cut surfaces is relatively small and thus the surfaces come into contact with each other, a gap is formed between the contact surfaces. Thereby, the processed surfaces are prevented from adhering to each other in a vacuum. If the processed surfaces do not adhere to each other in a vacuum, the adhesion force acting therebetween is reduced. Accordingly, the slits 4 are allowed to smoothly open in accordance with the flexure of the blade member 5, and the effect of preventing the loss of resilience by providing the slits 4 is sufficiently exerted.

The process of providing the slits 4 by using the processing device that produces rough cut surfaces is not limited to the process of providing the slashed slits 4, as illustrated in FIG. 14, and may be used in the process of forming the groove-like slits 4, as in Embodiment 6 described above with reference to FIGS. 13A to 13C.

A description will now be given of the example of the double-layer structured blade member 15 that is currently used, as illustrated in FIG. 3, wherein the edge layer 11 is not provided with the slits 4. This example discloses the double-layer structured blade member 15, in which the edge layer 11 has a function of scraping off the toner for an extended period of time and the backup layer 12 (referred as the base layer in this example) has a function of adjusting the pressure contact force of the edge layer 11. This example further discloses physical property values of the edge layer 11 and the backup layer 12 of the double-layer structured blade member 15, and a configuration including the edge layer 11 and the backup layer 12 having permanent set values of approximately 5% or lower and approximately 1.5% or lower, respectively.

This example, however, does not specify the permanent set value of the entire double-layer structure combining the edge layer 11 and the backup layer 12, and simply specifies the physical properties of the respective materials forming the edge layer 11 and the backup layer 12. As a result of extensive investigations carried out by the present inventors, it was revealed that, if the permanent set value of the entire double-layer structure combining the edge layer 11 and the backup layer 12 is equal to the permanent set value of a single-layer structure made of a material of relatively high hardness, long-term use causes the loss of resilience in the double-layer structure and a resultant cleaning failure. Therefore, if the permanent set value of the entire double-layer structure is relatively high in the double-layer structured blade member 15 of this example, long-term use causes the loss of resilience in the blade member 15, and the initial contact state is changed. This example is therefore limited in long-term maintenance of the cleaning performance.

Subsequently, the experiment carried out by the present inventors will be described. The inventors confirmed from the experiment that, if the permanent set value of the entire blade member is set to approximately 2% or lower, the degradation of the cleaning performance due to the loss of resilience can be kept within a range allowing the use of the blade member, even if the blade member has a uniform double-layer structure from the leading end to the root thereof, as illustrated in FIG. 3.

In the present experiment, a plurality of blade members having different configurations were prepared, and each of the blade members was kept in contact with a photoconductor for a predetermined long time to examine the degree of reduction over time in linear pressure with respect to the initial linear pressure. TABLE 1 lists the respective configurations of Blades 1 to 7, i.e., seven types of blade members used in the experiment.

TABLE 1

| | | ENTIRETY | | EDGE LAYER | | BACKUP LAYER | |
|---|---|---|---|---|---|---|---|
| BLADE NO. | CONFIGURATION | 100% M [Mpa] | PERMANENT SET [%] | 100% M [Mpa] | PERMANENT SET [%] | 100% M [Mpa] | PERMANENT SET [%] |
| 1 | SINGLE-LAYER | 4 | 1 | — | — | — | — |
| 2 | SINGLE-LAYER | 5.3 | 2.1 | — | — | — | — |
| 3 | SINGLE-LAYER | 6.2 | 2.3 | — | — | — | — |
| 4 | SINGLE-LAYER | 7.5 | 2.6 | — | — | — | — |
| 5 | SINGLE-LAYER | 12 | 4.8 | — | — | — | — |
| 6 | DOUBLE-LAYER | — | 1.6 | 7.5 | 2.6 | 3.5 | 1.2 |
| 7 | DOUBLE-LAYER | — | 1.95 | 12 | 4.8 | 3 | 0.85 |

As Blades 1 to 5 in TABLE 1, which are single-layer structured blade members, blades having a thickness of approximately 1.8 mm and a free length of approximately 7.2 mm were used. Further, as Blades 6 and 7, which are double-layer structured blade members, blades having an edge layer thickness of approximately 0.5 mm, a backup layer thickness of approximately 1.3 mm, an entire blade thickness of approximately 1.8 mm, and a free length of approximately 7.2 mm were used. As illustrated in TABLE 1, the permanent set value of the entire blade is approximately 1.6% in Blade 6 and approximately 1.95% in Blade 7.

Each of Blades 1 to 7 illustrated in TABLE 1 was left in an image forming unit for 240 hours while in contact with a photoconductor. In the meantime, chronological data of the acting force (i.e., linear pressure) of the blade member was measured. Further, deformed toner cleaning performance and spherical toner cleaning performance of the blade member were also checked. The results of the measurements are listed in TABLE 2.

TABLE 2

| BLADE NO. | PERMANENT SET [%] | LINEAR PRESSURE REDUCTION RATE [%] | INITIAL STATE DEFORMED TONER | INITIAL STATE SPHERICAL TONER | 80K STATE DEFORMED TONER | 80K STATE SPHERICAL TONER |
|---|---|---|---|---|---|---|
| 1 | 1 | 97.7 | GOOD | POOR | GOOD | POOR |
| 2 | 2.1 | 92 | GOOD | POOR | GOOD | POOR |
| 3 | 2.3 | 88.5 | GOOD | GOOD | GOOD | POOR |
| 4 | 2.6 | 87.5 | — | GOOD | — | POOR |
| 5 | 4.8 | 78 | — | GOOD | — | POOR |
| 6 | 1.6 | 93.2 | — | GOOD | — | GOOD |
| 7 | 1.95 | 91.4 | — | GOOD | — | GOOD |

Figure 15:
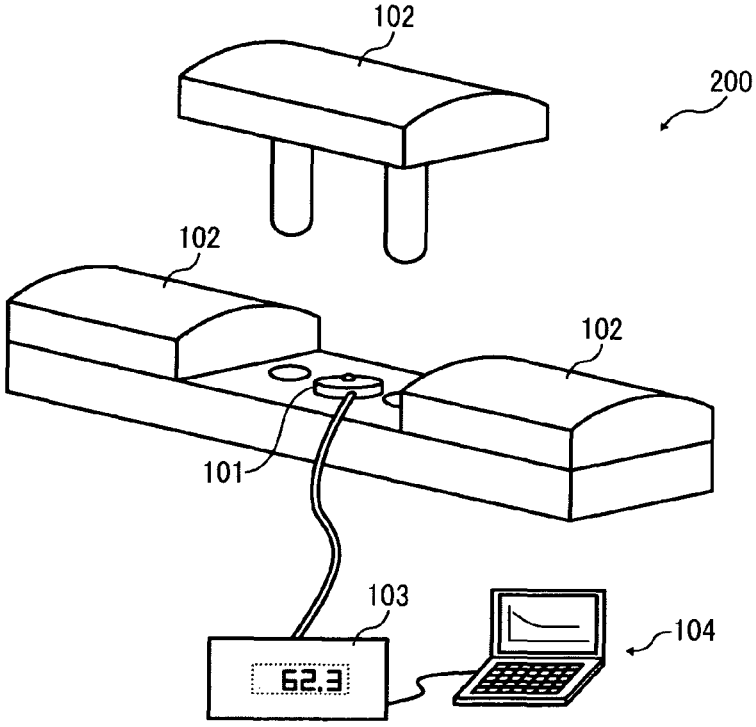
FIG. 15 is a perspective explanatory view of a measuring device.
Figure 16:
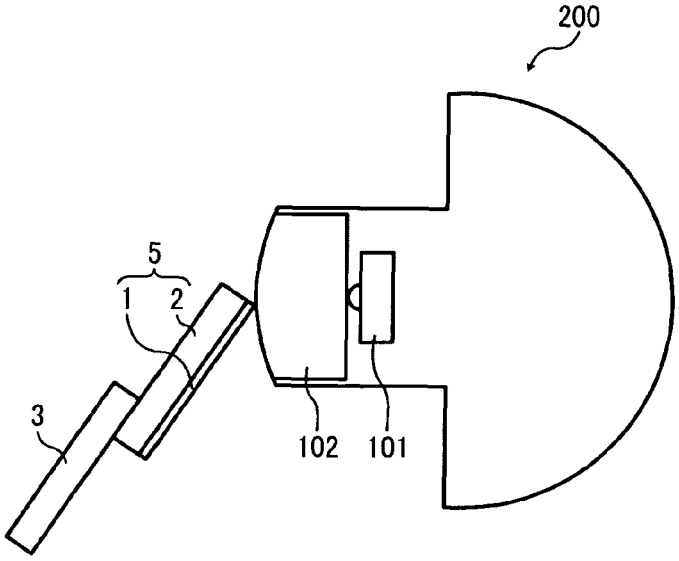
FIG. 16 is a side explanatory view of the measuring device.

FIGS. 15 and 16 are explanatory diagrams of a measuring device 200 that measures the liner pressure. The measuring device 200, which measures the liner pressure generated by the contact of a blade attached thereto, has a diameter corresponding to the diameter of the photoconductor 10, and includes a pad 102 provided at a location that comes into contact with the edge layer 1 of the blade member 5. The pad 102 is configured to be divided into three sections in the longitudinal direction thereof, and transmits the acting force of the blade member 5 to a load cell 101, which is arranged to be in contact with each of the three sections of the pad 102. The load cell 101 may be, for example, a load cell LMA-A-10N manufactured by Kyowa Electronic Instruments Co., Ltd. The measuring device 200 further includes a panel 103 for displaying the force acting on the load cell 101. The panel 103 may be, for example, an instrumentation panel WGA-650 manufactured by Kyowa Electronic Instruments Co., Ltd. Further, a logger 104 for logging with a personal computer is prepared to chronologically record measurement values measured by the load cell 101. Each of the blade members is attached to the measurement device 200 in a layout based on practical usage. As for the recorded measurement values, the initial value, i.e., the measurement value measured after the attachment of the blade member to the measurement device 200 is compared with the measurement value measured after the lapse of a predetermined time. Thereby, the reduction rate of the linear pressure is calculated. In the illustrated example, the pad 102 used for the measurement is divided into three sections. However, the number of divided sections of the pad 102 may be arbitrarily determined.

The linear pressure reduction rate in TABLE 2 represents the percentage of the linear pressure measured after the lapse of 240 hours to the initial linear pressure, and is the value calculated as (linear pressure measured after the lapse of 240 hours)/(initial linear pressure)×100. The deformed toner in TABLE 2 is polymerized toner including toner particles having a circularity of approximately 0.96 and a particle diameter of approximately 6 μm, and the spherical toner in TABLE 2 is polymerized toner including toner particles having a circularity of at least approximately 0.98 and a particle diameter of approximately 4 μm. Further, the cleaning performance of the individual blade was determined in the initial state and the 80K state in TABLE 2. In the initial state, the determination was made on samples of the 1st to 1,000th fed sheets. In the 80K state, the determination was made on samples of the 79,000th to 80,000th sheets among 80,000 fed sheets. In the determination of the cleaning performance, GOOD indicates that there is no cleaning failure visible on sheets, and POOR indicates that there is a cleaning failure visible on sheets. As illustrated in TABLE 2, among Blades 1 to 5, which are single-layer structured blade members, Blades 1 and 2 relatively low in permanent set value have linear pressure reduction rates of approximately 97.7% and approximately 92%, respectively. That is, it was confirmed that the reduction in linear pressure is suppressed in Blades 1 and 2. Meanwhile, in Blades 3, 4, and 5 relatively high in permanent set value, the linear pressure is reduced over time to linear pressure reduction rates of approximately 88.5%, approximately 87.5%, and approximately 78%, respectively. That is, so-called loss of resilience occurs in Blades 3, 4, and 5.

Each of Blades 1 and 2 has a permanent set value of approximately 2.0% or lower, and is made of a material relatively low in permanent set value. Thus, the amount of reduction in linear pressure is relatively small in Blades 1 and 2, and Blades 1 and 2 maintain the deformed toner cleaning performance for a relatively long time, and exhibit favorable deformed toner cleaning performance in the 80K state. Blades 1 and 2, however, have 100% modulus values of approximately 4 MPa (MegaPascals) and approximately 5.3 Mpa, respectively, which are not sufficiently high. Therefore, Blades 1 and 2 fail to obtain sufficiently high contact pressure at the nip portion in which the leading end of the blade and the photoconductor come into contact with each other, and are unable to clean the spherical toner in the initial state.

Blade 3 has a slightly higher permanent set value of approximately 2.3% and a linear pressure reduction rate lower than 90%, and a slight loss of resilience occurs in Blade 3. Blade 3, however, has a 100% modulus value of approximately 6.2 Mpa, and is made of a relatively high modulus material. Therefore, Blade 3 obtains favorable deformed toner cleaning performance in the 80K state. Blade 3 further obtains favorable spherical toner cleaning performance in the initial state.

Blades 6 and 7 use the material of Blade 4 and the material of Blade 5, respectively, in the edge layer thereof, and use a material having a relatively low permanent set value in the backup layer thereof. Thereby, the permanent set value of the entire double-layer structure was improved to approximately 1.6% in Blade 6 and to approximately 1.95% in Blade 7. The measurement result of the linear pressure reduction rate is approximately 93.2% in Blade 6 and approximately 91.4% in Blade 7. In Blades 6 and 7, the reduction over time in linear pressure is suppressed, and a linear pressure reduction rate of approximately 90% or higher is maintained.

Further, the respective edge layers of Blades 6 and 7 have relatively high 100% modulus values of approximately 7.5 MPa and approximately 12 Mpa, respectively. Therefore, Blades 6 and 7 are capable of easily obtaining relatively high contact pressure, and thus obtain sufficient spherical toner cleaning performance in the initial state. Further, the permanent set value of the entire blade is set not to exceed approximately 2.0%. Therefore, Blades 6 and 7 maintain the spherical toner cleaning performance for a relatively long time, and obtain favorable spherical toner cleaning performance in the 80K state.

The above-described experiment example indicates that, even if a material having a permanent set value exceeding approximately 2% and a relatively high 100% modulus value is used in the edge layer, the loss of resilience is suppressed by a configuration in which a material having a permanent set value of approximately 2% or lower is used in the backup layer to set the permanent set value of the entire blade member to approximately 2% or lower. Further, if a material having a 100% modulus value of approximately 6 Mpa or higher and capable of providing relatively high contact pressure is used in the edge layer, the cleaning failure in cleaning polarized toner including small-diameter spherical toner particles, which are herein assumed to have a circularity of approximately 0.98 or higher and a particle diameter of approximately 4 μm, is suppressed.

A uniform blade as in the above-described experiment example can be configured to attain both relatively high contact pressure and maintenance of the initial contact state, depending on the combination of materials forming the edge layer and the backup layer. However, in the configuration that uses a material having a relatively high 100% modulus value to form the edge layer, and which sets the permanent set value of the entire blade member to approximately 2% or lower, the selection of materials and the combination of thicknesses are limited.

Meanwhile, the configuration including the slits 4 in the edge layer 1, as in the blade member 5 of the present embodiment, is capable of suppressing the influence of the loss of resilience occurring in the edge layer 1. Therefore, even if the entirety of the double-layer structured blade member not provided with the slits 4 has a permanent set value exceeding approximately 2%, the linear pressure reduction rate can be increased to approximately 90% or higher by providing slits 4 to the blade member and adjusting the depth or shape of the slits 4, as long as the permanent set value of the backup layer 2 does not exceed approximately 2%. In the cleaning device 30 including the blade member 5 of the present embodiment, therefore, the limits on the selection of materials and the combination of thicknesses can be reduced in the configuration capable of attaining both relatively high contact pressure and maintenance of the initial contact state.

In the above-described embodiments, the cleaning device 30 that includes the laminate-structured blade member 5 including the edge layer 1 having a relatively high permanent set value and the backup layer 2 having a relatively low permanent set value is configured to remove foreign materials adhering to a surface of the photoconductor 10 as a cleaning target. The cleaning target cleaned by a cleaning device including a blade member similar to the blade member 5 of the present embodiment is not limited to the photoconductor. For example, a blade member similar to the blade member 5 may be used as a cleaning member of the intermediate transfer belt cleaning device 167 for cleaning the intermediate transfer belt 162 as the cleaning target. Further, the cleaning target is not limited to the toner image carrying member, such as the photoconductor 10 and the intermediate transfer belt 162. Thus, a blade member similar to the blade member 5 may be used as a cleaning member of a cleaning device for cleaning a recording medium conveying belt, which conveys a recording medium having an untransformed toner image formed thereon, as the cleaning target. Further, the image forming apparatus including the recording medium conveying belt is not limited to the electrophotographic image forming apparatus. Thus, a blade member similar to the blade member 5 may be used as a cleaning member of a cleaning device for cleaning the recording medium conveying belt included in an inkjet image forming apparatus. Further, the blade member 5, which is configured to come into contact with the photoconductor 10 in accordance with a counter method in the present embodiment, may alternatively employ a trailing method as the contact method.

As described above, the cleaning device 30 of the present embodiment includes the laminate-structured blade member 5 formed by a plurality of layers made of materials different in permanent set value and the blade holder 3 serving as a holding member holding one end of the blade member 5. The cleaning device 30 is configured to clean a surface of the photoconductor 10, i.e., a moving surface of a cleaning target, by bringing the edge portion 1*e*, which corresponds to a leading end ridgeline portion on the other end of the blade member 5, into contact with the surface of the photoconductor 10. The edge layer 1, which is one of the plurality of layers forming the blade member 5 and includes the edge portion 1*e*, is made of a material higher in permanent set value than the material forming the backup layer 2, i.e., one of the plurality of layers other than the edge layer 1.

In the thus configured cleaning device 30, the edge layer 1 includes, in an area on a surface thereof from the edge portion 1*e* to the holding position 5*a* at which the blade member 5 is held by the blade holder 3, the plurality of slits 4 extending in a direction perpendicular to the moving direction of the surface of the photoconductor 10. With the plurality of slits 4 provided in the surface of the edge layer 1, a layer other than the edge layer 1 is flexed in a state in which the blade member 5 is pressed and flexed against the photoconductor 10, and the slits 4 of the edge layer 1 open along the flexed layer. The slits 4 of the edge layer 1 open in the flexed state of the blade member 5. Therefore, unlike the configuration in which the loss of resilience occurs in the edge layer 11 extending over the entire area from the holding position 15*a* to the edge portion 11*e*, as in the configuration illustrated in FIG. 3, the force in the flexing direction is prevented from acting on the backup layer 2, i.e., the layer other than the edge layer 1. Therefore, it is possible to attain both relatively high contact pressure and maintenance of the initial contact state, similarly as in the configuration described above with reference to FIGS. 4A and 4B. Further, the present embodiment is obtained simply by providing the slits 4 in the edge layer 1 of the blade member 5 formed into a double-layer laminated structure. Thus, a new method is unnecessary, and effort for removing a portion of the edge layer 1 other than the leading end portion thereof is also unnecessary. The present embodiment, therefore, is suitable for mass production. Accordingly, the blade member 5 suitable for mass production attains both relatively high contact pressure and maintenance of the initial contact state.

Further, if the slits 4 are applied with the adhesion inhibitor 9 for inhibiting adjacent cross sections of the slits 4 from adhering to each other, as in Embodiment 5, the adjacent cut surfaces of the slits 4 are prevented from adhering to each other. Thus, the slits 4 are allowed to smoothly open in accordance with the flexure of the blade member 5. Accordingly, the effect of preventing the loss of resilience by providing the slits 4 is sufficiently exerted.

Further, if the slits 4 are subjected to the cross-section adhesion preventing process for inhibiting adjacent cross sections of the slits 4 from adhering to each other, as in Embodiments 6 and 7, the adjacent cut surfaces of the slits 4 are prevented from adhering to each other. Accordingly, the slits 4 are allowed to smoothly open in accordance with the flexure of the blade member 5, and the effect of preventing the loss of resilience by providing the slits 4 is sufficiently exerted.

Particularly, if the slits 4 are formed into grooves each having a certain amount of width as the cross-section adhesion preventing process, as in Embodiment 6, the adjacent cut surfaces of the slits 4 are prevented from coming into contact with each other. To form the groove-like slits 4, the edge layer 1 is subjected to the removal process to form the slits 4 into V-shaped grooves, as illustrated in FIG. 13A. Thereby, the slits 4 are formed into the groove shape having few processing disadvantages in, for example, the processing method and the processing time.

Further, the groove-like slits 4 formed into a shape having rounded and not angular portions (i.e., corners) in which the direction of the surface of the slits 4 changes, as illustrated in FIGS. 13B and 13C, are effective in terms of prevention of a crack.

Particularly, if the cross sections of the slits 4 are subjected to the surface roughening process as the cross-section adhesion preventing process, as in Embodiment 7, a gap is formed between adjacent cut surfaces of the slits 4, even if the cut surfaces come into contact with each other. Thus, the cut surfaces are prevented from adhering to each other in a vacuum. Accordingly, adhesion between adjacent cut surfaces of the slits 4 is prevented.

Further, if the linear pressure reduction rate in the contact state of the blade member 5 with the photoconductor 10 is set to approximately 90% or higher, it is possible to attain both relatively high contact pressure and maintenance of the initial contact state, similarly as in a laminate-structured blade member, the entirety of which has a permanent set value of approximately 2% or lower.

Further, in the edge layer 1 of the blade member 5 used in the cleaning device 30 of the present embodiment, the slits 4 are provided in the surface of the edge layer 1, starting at a position apart from the edge portion 1*e* in contact with the surface of the photoconductor 10, i.e., the slits 4 are provided on the root side of a position apart from the edge portion 1*e* by the distance S. The distance S between the most leading end-side one of the slits 4 and the edge portion 1*e* is set to exceed the nip width N, i.e., approximately 100 μm. Accordingly, the blade member 5 is prevented from turning up at the most leading end-side one of the slits 4 as the starting point.

Further, if the depth d of the slits 4 provided in the edge layer 1 of the blade member 5 is set not to exceed the thickness t of the edge layer 1, the deepest portions of the slits 4 are prevented from penetrating the backup layer 2, and a reduction in strength of the blade member 5 attributed to a crack in the backup layer 2 is prevented.

Further, if the slits 4 are provided at a plurality of locations in an area extending to a position near the holding position 5*a* of the blade member 5, as indicated by the free length L1 in FIG. 8, the slits 4 open at an edge portion of the blade holder 3, on which the stress concentrates. Accordingly, a better effect of reducing the loss of resilience is obtained.

Further, the printer 100 according to the present embodiment finally transfers an image formed on the photoconductor 10, which is a latent image carrying member having a moving surface; onto a transfer sheet serving as a recording medium. The printer 100 includes the process cartridge 121 that is configured to be attachable to and detachable from the body of the printer 100, and that integrally supports the photoconductor 10 and the cleaning device that removes unnecessary foreign materials adhering to the surface of the photoconductor 10 as the above-described cleaning target. With the use of the cleaning device 30 of the present embodiment as the cleaning device of the process cartridge 121, the process cartridge 121 attains both relatively high contact pressure and maintenance of the initial contact state, and is capable of favorably cleaning the photoconductor 10 for a relatively long time.

Further, the printer 100 transfers a toner image formed on the photoconductor 10, which is an image carrying member having a moving surface, onto the intermediate transfer belt 162 serving as an intermediate transfer member, and finally transfers the toner image onto a transfer sheet serving as a recording medium. The printer 100 includes the secondary transfer device 160 serving as an intermediate transfer unit that is configured to be attachable to and detachable from the body of the printer 100, and that integrally supports the intermediate transfer belt 162 and the intermediate transfer belt cleaning device 167 serving as a cleaning device that removes unnecessary foreign materials adhering to the surface of the intermediate transfer belt 162 as the cleaning target. If a cleaning device including a blade member similar to the cleaning device 30 is used as the intermediate transfer belt cleaning device 167, the secondary transfer device 160 is capable of favorably cleaning the intermediate transfer belt 162 for a relatively long time.

Further, the printer 100 is an image forming apparatus that finally transfers a toner image formed on the photoconductor 10, which is a surface moving member, onto a transfer sheet. With the use of the cleaning device 30 as a cleaning device for removing unnecessary foreign materials adhering to the surface of the photoconductor 10, the photoconductor 10 is favorably cleaned for a relatively long time, and the printer 100 is capable of performing a favorable image forming operation.

The toner forming the toner image in the printer 100 is a polarized toner including toner particles having a shape factor SF1 in a range of approximately 100 to approximately 150. Some of polarized toners include substantially spherical toner particles, and are capable of forming a high-quality toner image. To remove such spherical toner particles, however, a high level of removal performance is necessary. The cleaning device 30 attains both relatively high contact pressure and maintenance of the initial contact state, and thus is capable of favorably cleaning the spherical toner particles requiring a high level of removal performance. Accordingly, the printer 100 is capable of stably forming a high-quality image.

Further, some of image forming apparatuses include a recording medium conveying unit that is configured to be attachable to and detachable from the body of the image forming apparatus that forms an image on a recording medium carried on a surface of a recording medium conveying belt serving as a recording medium conveying member being a surface moving member, and that integrally supports the recording medium conveying belt and a conveying belt cleaning device for removing unnecessary foreign materials adhering to the surface of the recording medium conveying belt as the cleaning target. If a cleaning device including a blade member similar to the cleaning device 30 is used as the conveying belt cleaning device of the thus configured image forming apparatus, the recording medium conveying unit is capable of favorably cleaning the recording medium conveying belt for a relatively long time.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape, are not limited the embodiments and thus may be preferably set. It is therefore to be understood that within the scope of the appended claims, the disclosure of this patent specification may be practiced otherwise than as specifically described herein.

The invention claimed is:

1. A cleaning device for cleaning a moving surface of a cleaning target, the cleaning device comprising:

a laminate-structured blade member including multiple layers made of materials having different permanent set value;

the multiple layers including an edge layer formed of a material higher in permanent set value than any other one of the materials of the multiple layers of the laminate-structured blade member, the edge layer including a distal-end edge portion corresponding to a leading end ridgeline portion and brought into contact with the surface of the cleaning target;

a holding member to hold a proximal end of the laminate-structured blade member; and a plurality of slits formed on a surface of the edge layer over an area of the edge layer ranging from the proximal end of the blade member where the holding member holds the blade member toward the distal-end edge portion, the slits extending in a direction intersecting a moving direction of the surface of the cleaning target.

2. The cleaning device according to claim 1, further comprising an adhesion inhibitor applied to the slits to inhibit adjacent slits thereof from adhering to each other.

3. The cleaning device according to claim 1, wherein the slits are V-shaped grooves in cross-section.

4. The cleaning device according to claim 1, wherein the slits are rounded grooves in cross-section.

5. The cleaning device according to claim 1, wherein surfaces of the slits are roughened.

6. The cleaning device according to claim 1, wherein a linear pressure reduction rate in a state of contact of the blade member with the cleaning target is approximately 90% or higher.

7. The cleaning device according to claim 1, wherein the slits are provided in an area on the surface of the edge layer apart from a portion of the edge layer in contact with the surface of the cleaning target.

8. The cleaning device according to claim 1, wherein the depth of the slits is equal to or smaller than the thickness of the edge layer.

9. The cleaning device according to claim 1, wherein the slits are provided at a plurality of locations in an area extending to the proximal end of the blade member near a holding position.

10. The cleaning device according to claim 9, wherein an arrangement of intervals of the slits is different between the proximal end of the blade member and the distal-end portion of the edge layer of the blade member.

11. The cleaning device according to claim 9, wherein an arrangement of depths of the slits is different between the proximal end of the blade member and the distal-end portion of the edge layer of the blade member.

12. A process cartridge disposed detachably attachable to the body of an image forming apparatus, the process cartridge comprising:

a latent image carrying member includes a moving surface to which an image is formed and transferred onto a recording medium; and the cleaning device according to claim 1, integrally supported with the latent image carrying member for removing unnecessary foreign material adhering to the surface of the latent image carrying member.

13. An intermediate transfer unit detachably attachable to the body of an image forming apparatus, the intermediate transfer unit comprising:

an intermediate transfer member to receive an image from a moving surface of an image carrying member onto the surface of the cleaning target and finally transfer the image onto a recording medium; and the cleaning device according to claim 1, integrally supported with the intermediate transfer member.

14. An image forming apparatus to ultimately transfer, onto a recording medium, an image formed on a moving surface of an image carrying member serving as a moving surface member, the image forming apparatus comprising the cleaning device according to claim 1.

15. The image forming apparatus according to claim 14, wherein toner particles forming the image have a shape factor SF1 in a range of from approximately 100 to approximately 150.

16. The cleaning device according to claim 1, wherein an arrangement of intervals of the slits is different between the proximal end of the blade member and the distal-end portion of the edge layer of the blade member.

17. The cleaning device according to claim 1, wherein the slits are provided along a length direction of the blade member.

* * * * *